United States Patent [19]

Snedkerud

[11] 4,209,789

[45] Jun. 24, 1980

[54] ROTATABLE AERIAL INSTALLATION MOUNTED ON A MAST WITH REMOTE MECHANICAL DRIVE

[75] Inventor: Ole Snedkerud, Windisch, Switzerland

[73] Assignee: BBC Brown, Boveri & Company, Limited, Baden, Switzerland

[21] Appl. No.: 945,091

[22] Filed: Sep. 25, 1978

[30] Foreign Application Priority Data

Sep. 30, 1977 [CH] Switzerland ..... 11957/77

[51] Int. Cl.[2] ..... H01Q 1/34; H01Q 3/03

[52] U.S. Cl. ..... 343/765; 343/890

[58] Field of Search ..... 343/709, 710, 765, 766, 343/DIG. 2, 705, 708, 890

[56] References Cited

U.S. PATENT DOCUMENTS

| | | | |
|---|---|---|---|
| 3,495,261 | 2/1970 | Lastinger et al. | 343/766 |
| 3,624,656 | 11/1971 | Kaschak | 343/766 |
| 3,707,721 | 12/1972 | McCartney | 343/766 |

*Primary Examiner*—Eli Lieberman

*Attorney, Agent, or Firm*—Orville N. Greene; Frank L. Durr

[57] ABSTRACT

Slip-ring electrical contacts are avoided in a rotatable aerial or antenna of the type which is housed in a rotatable cage or basket having a supporting platform at the top of a mast, by constructing the electrical transmitting/receiving apparatus and the drive and control units for the rotating aerial at some region below the supporting platform for the rotating cage or basket, e.g., below deck in the case of a ship, and by transmitting the signal to or from the aerial by means of a wave guide concentrically arranged below and surrounding the axis of rotation of the cage, including a quarter wave joint surrounding the wave guide (with a clearance) on the platform, and connecting the wave guide to the aerial with the aid of a probe extending into the wave guide, two motor devices operating through differential gearing, all included in the region below the platform enabling the azimuth and elevation of the aerial to be determined.

5 Claims, 7 Drawing Figures

ROTATABLE AERIAL INSTALLATION MOUNTED ON A MAST WITH REMOTE MECHANICAL DRIVE

This invention concerns a rotatable aerial installation, especially for satellite ship and ground stations, with a mast at the upper end of which the transmit/receive aerial is housed in a rotatable basket.

Transmitter, receiver as well as a transmit/receive aerial were originally housed in the rotatable cage or basket at the tip of the mast in the case of such satellite transmit and receive stations.

Since it seemed desirable, especially in oceangoing vessels, to avoid slip-ring contacts for the current supply to the electric motors which control the azimuth and elevation angles of the parabolic aerial and for the Hi-fi systems, one has changed over to long cables for the electrical supply which connect a below-deck current source to the loads housed in the rotatable basket at the tip of the mast. However, this solution involves the disadvantage that the pivoting range for the aximuth is limited to between 370° and 540°, depending upon the design.

The construction referred to initially in which case all receiving, transmitting, drive and control units are housed in a rotatable basket at the tip of the mast, still suffers from a further disadvantage, apart from the abovementioned disadvantages, namely that access to these units becomes very difficult, which may be of critical importance, especially in the case of failure during bad weather or in heavy seas.

In the case of the design without slip-rings and with long cables, the limited azimuth angle of rotation may interrupt communications—a disadvantage which must be avoided at all costs in certain applications.

The present invention has for its object to avoid these disadvantages. Its task, in particular, is to provide a connection without slip rings between the transmit/-receive section and the aerial and to construct the azimuth and elevation angle controls in such a way that the electrical drive and control units are accommodated below the ships deck or at the base of the mast or below the latter.

The rotatable aerial installation of the invention is characterized in that, in a turntable which rotates about a vertical axis within a basket at the tip of the mast there is provided a gear rim with a single gearing for the azimuth displacement and a gear rim with internal/external double gearing for elevation displacement, these rims being rotatably supported coaxially and independently of one another, that a differential gear is provided having drive and driven shafts for moving the two gear rims which allows these two rims to be driven in the same or in opposite directions and at idential or different speeds, in order to effect both azimuth and elevation displacement either separately or simultaneously, that an intermediate shaft is provided between the gear rim for elevation displacement and the rotational axis of the aerial, and that there are provided, a fixed wave guide which is concentric with the rotational axis of the azimuth movement, a quarter-wave joint mounted on the turntable and surrounding the upper end of wave guide with a clearance, and a wave guide probe for transmitting signals between the transmit/receive installation—situated either inside or outside the tubular mast—and the aerial, and vice-versa.

The invention will now be explained in further detail with reference to the drawings.

Figure 1:
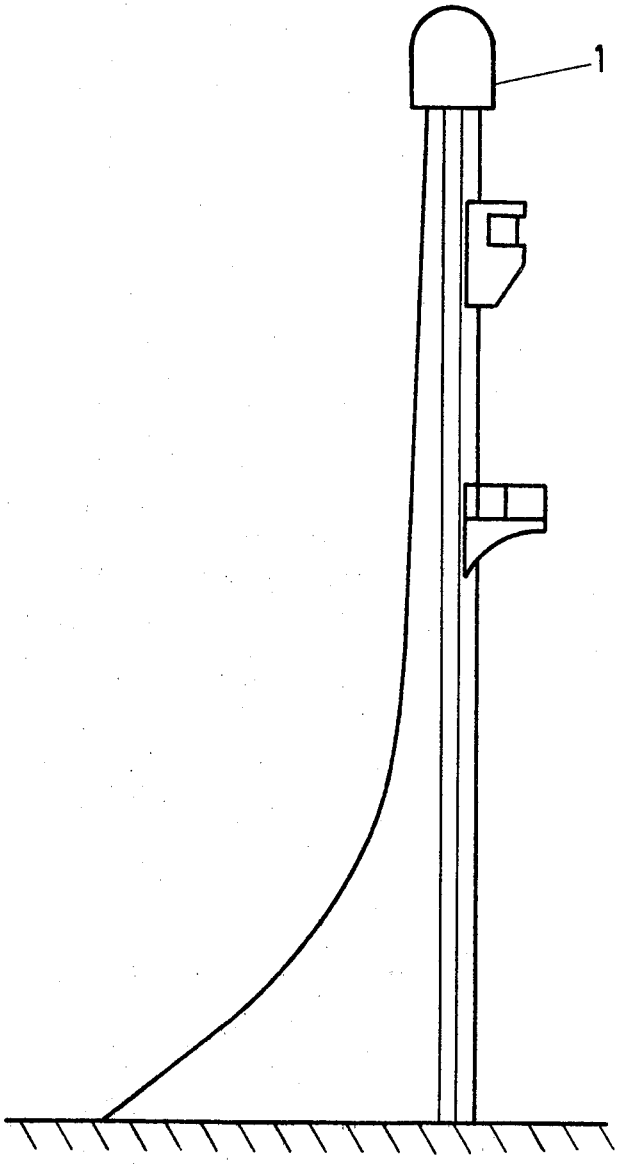
FIG. 1 shows the outlines of a telecommunications station according to the invention, in the shape of a ship-borne mast.

The ship-borne transmit/receive station shown in FIG. 1 in the shape of a streamlined mast is outwardly indistinguishable from the conventional designs referred to initially. However, in contradistinction from the latter, the basket 1, rotatable about a vertical axis on the tip of the mast, contains only the aerial and drive elements for the latter's displacement in azimuth and elevation.

Figure 2:
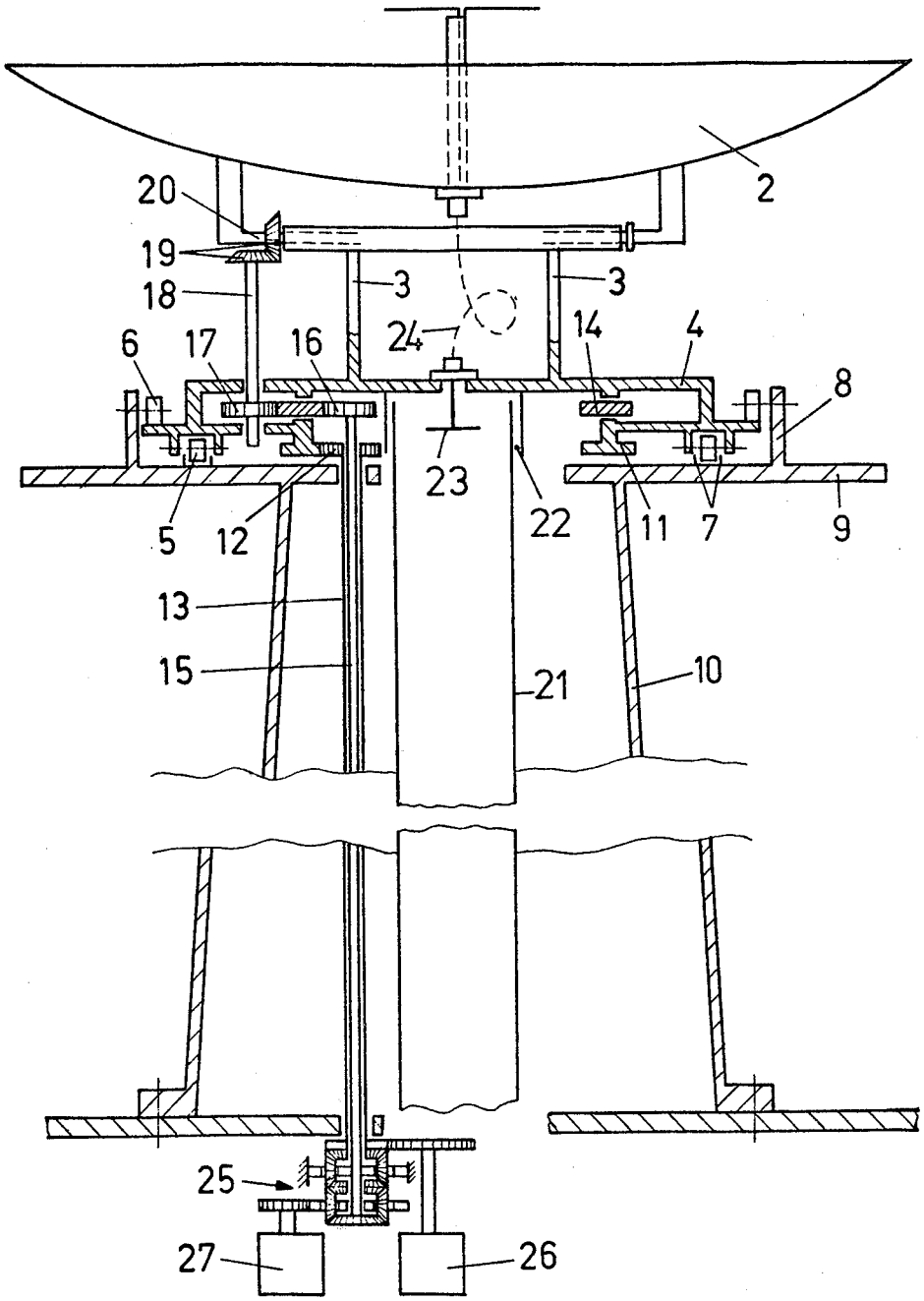
FIG. 2 shows diagrammatically an embodiment of the device of the invention, in sectional view.

FIG. 2 shows in diagrammatic representation a cross-section of such a mast. The aerial, in the present case a parabolic aerial, and its support are denoted by the reference numeral 2. The aerial support rests on legs 3 which are positively connected to a turntable 4. This turntable is rotatably supported and secured against tilting by moving rollers 5 which are guided in circular rails 7 and by rollers 6 fixed in a cylindrical shell 8. The circular rails 7 and the shell 8 are positively connected to a platform 9 which constitutes the upper closure of the tubular mast 10.

The turntable 4 is provided with a rim having an internal gear 11 for azimuth displacement which engages a spur gear 12 at the upper end of a hollow shaft 13. In the turntable 4, a rim 14 with external and internal gears for elevation displacement is rotatably supported coaxially of the gear rim 11, above said rim 11. This gear rim 14 meshes internally with a spur gear 16 seated at the upper end of a solid shaft 15 and, externally, with a spur gear 17, the movement of the latter being transmitted by a shaft 18 to the pair of bevel gears 19 and thus to the pivoting axle 20 of the aerial support.

The transmit/receive installation, now shown here, is housed below deck and therefore easily accessible for maintenance and monitoring purposes. For transmission without slip-rings of the incoming and outgoing signals, there are provided a wave guide 21 arranged coaxially of the rotational axis of the turntable 4, a quarter-wave joint 22 surrounding the upper end of the wave guide with a clearance and mounted on the underside of the turntable, and a wave guide probe 23 arranged in the axis of the turntable, the probe being connected to the aerial 2 by means of a coaxial cable 24.

Figure 3:
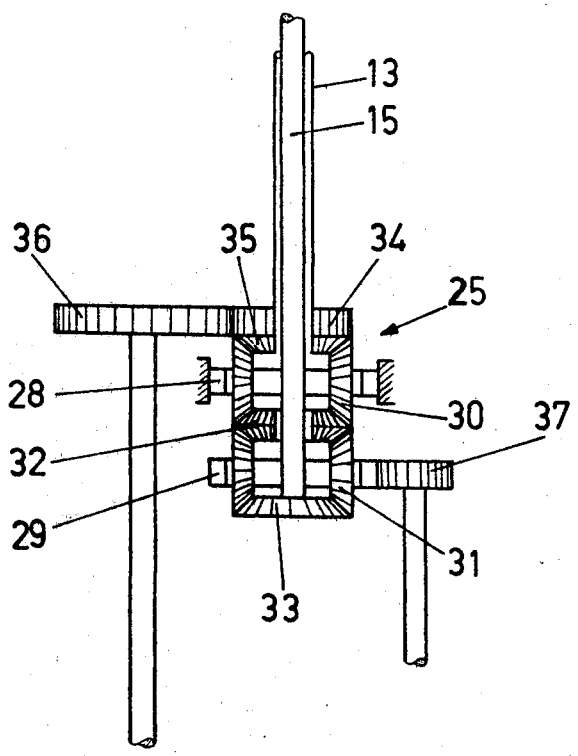
FIG. 3 shows the differential gear of the embodiment according to FIG. 2.

Below deck there are further provided the differential gear 25, shown enlarged in FIG. 3, the two motors 26 and 27 for azimuth and elevation control, and the position indicators (not shown here).

The differential gear 25 (FIG. 3) is provided with a fixed satellite carrier 28 and a moving satellite carrier 29 whose planet gears 30 and 31 cooperate via a free-running double bevel gear 32. The planet gear 31 engages with a bevel gear 33 at the lower end of the solid shaft 15, in order to control the angle of elevation. The hollow shaft 13 is provided, at its lower end, with a spur gear 34 which is rigidly connected to a bevel gear 35 and is driven by the electric motor 26 (see FIG. 2) via a spur gear 36.

The movable satellite carrier 29 is formed in the shape of a spur gear at its periphery which, via a spur gear 37, is in operative connection with the electric motor 27 (see FIG. 2).

If it is only intended to alter the angle of azimuth, the hollow shaft 13 is driven by electric motor 26 in the desired direction, while electric motor 27 is stopped and arrested. Via bevel gears 35, 30, 32 and 31, the solid shaft 15 is driven in the same direction and at the same speed as the hollow shaft 13. Since the upper spur gears 12 and 16 (see FIG. 2) of the hollow shaft 13 and the solid shaft 15, as well as the internal gearings of the rims 11 and 14 have mutually identical pitch circle diameters and the same number of teeth, there is no relative movement between the rims 11 and 14. With the shaft 18 of the elevation control supported in the turntable 4, which forms a rigid unit with rim 11, the spur gear 17 on shaft 18 also remains static, and consequently, elevation remains unaffected. As a result, only the angle of azimuth is altered.

If it is only intended to alter the elevation angle, then the solid shaft 15 is driven by the electric motor 27 via the spur gear 37 and the planet gears 31 which can freely rotate with the satellite carrier 29. The electric motor 26 for the azimuth control is arrested during this operation, and the hollow shaft 13 as well as the gears 36, 34, 35, 30 and 32 are at rest. Via the spur gear 16, the rim 14 with the interior and exterior gearing which is rotatably supported relative to the turntable 4, the spur gear 17 and the pair of bevel gears 19, the rotation of the solid shaft is transmitted to the tilting axle 20 of the aerial, and elevation is thus adjusted.

If it is intended to alter azimuth and elevation simultaneously, then the azimuth displacement takes place, as described above, by means of the motor 26 and the hollow shaft 13, whereas elevation is effected by the superimposition of a rotary movement of the solid shaft 15 originating from the electric motor 27. The motor 27 may be driven in the same direction as the hollow shaft, or in the opposite direction, whereby the toothed rim 14 leads or lags with respect to the toothed rim 11 which is positively connected to the turntable, the spur gear 17 and the aerial 2 being rotated in one or the other direction accordingly.

Housing the motors, the differential gear, the position transmitters, etc. below deck is of great advantage from the point of view of access and maintenance and also for reasons of weight—lighter basket and mast.

In certain cases, it may also be advisable to install drive motors and gears below the platform 9. It this way, the large torsion angle of the long shaft can be avoided. However, this angle may also be compensated by the abovementioned position transmitters, whereby the advantages of the installation units installed below deck are preserved.

Figure 4:
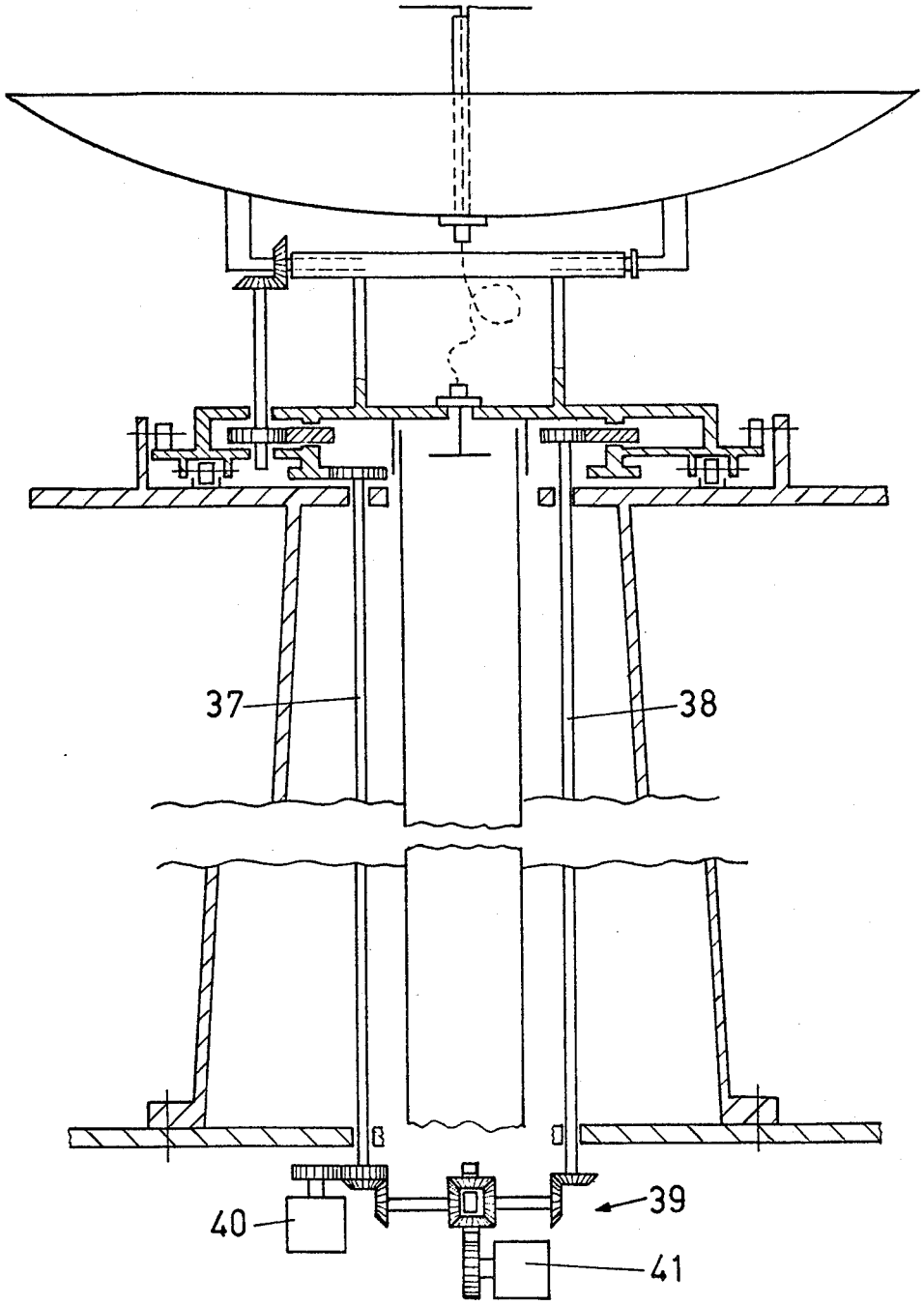
FIG. 4 is another embodiment in diagrammatic representation.
Figure 5:
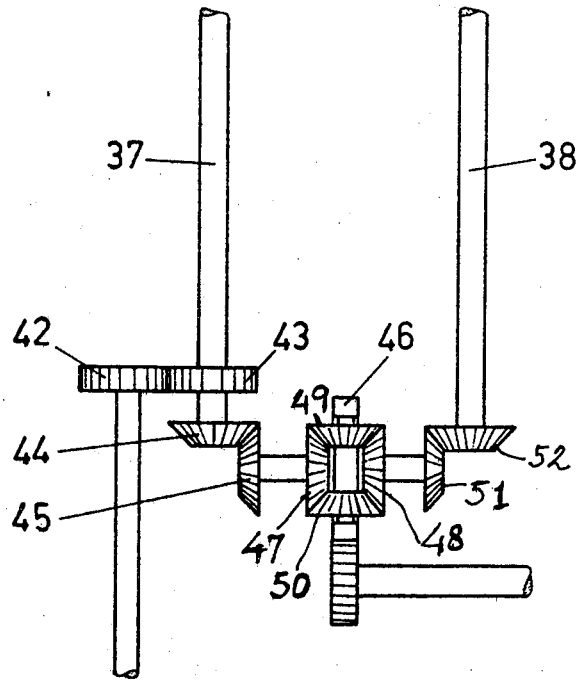
FIG. 5 shows the differential gear of the embodiment according to FIG. 4.

FIG. 4 shows an embodiment of the invention comprising two solid shafts 37 and 38 spaced apart from one another, for driving the aerial rims for azimuth and elevation adjustment. The other elements in the basket are substantially the same as in the previously described embodiment; it is only with regard to the drive means 39, installed below deck and shown enlarged in FIG. 5, that this variant differs from that shown in FIG. 2.

The drive unit 39 again comprises two motors, 40 and 41 respectively (FIG. 4), for azimuth and elevation control. For the purpose of pure azimuth adjustment, the motor 40 drives the shaft 37 via the pair of spur gears 42,43 and the fixed satellite carrier 46 via the pair of bevel gears 44, 45 the two bevel gears 47 and 48, the planet gears 49 and 50 and the pair of bevel gears 51,52 drives the shaft 38 in the same direction and at the same speed, so that—as in the earlier described example—a relative rotation between the geared rims for azimuth and elevation displacement does not occur and the existing elevation is therefore preserved. During this operation, the elevation motor 41 is arrested and the satellite carrier blocked.

For the purpose of pure elevation adjustment, the azimuth motor 40 is braked, so that only the shaft 38 is driven by the motor 41.

In order to effect simultaneous adjustment of azimuth and elevation, a rotary movement is superimposed by the motor 41 on the shaft 38 which latter is synchronously driven via the shaft 37 by the motor 40.

Figure 6:
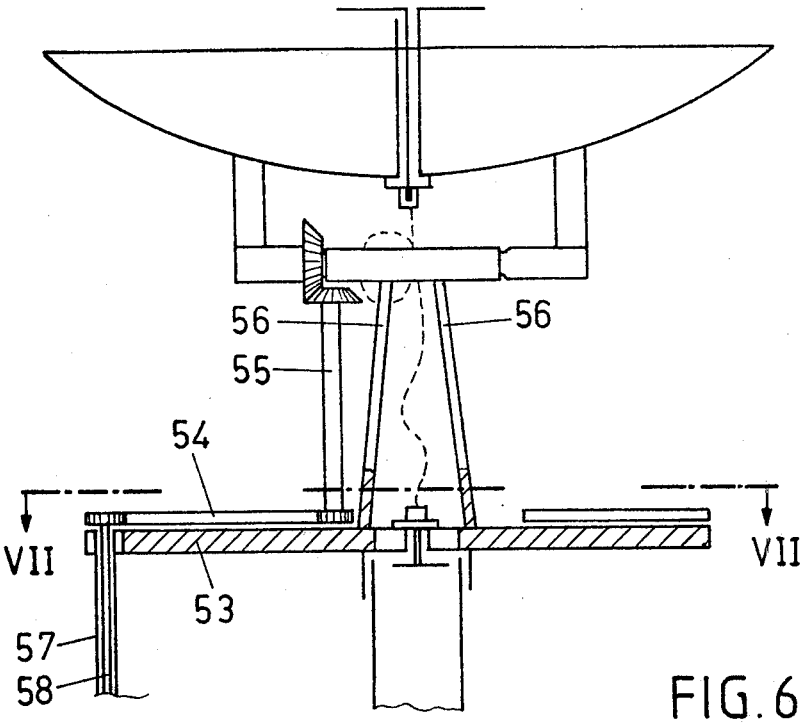
FIGS. 6 and 7 illustrate another embodiment in side elevation and in plan views.
Figure 7:
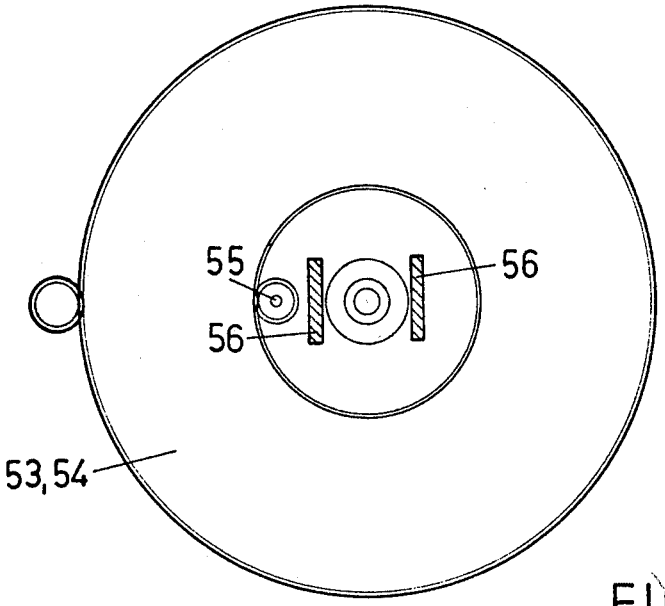

Another embodiment, simplified as regards the turntable in the basket, has been illustrated in FIGS. 6 and 7 in side elevation and in plan views, respectively. Here, the turntable consists of a round disc forming the geared rim 53 for azimuth displacement, on which the geared rim 54, the shaft 55 for elevation displacement, and the legs 56 for the aerial support, are supported. The hollow shaft 57 for azimuth displacement and the solid shaft 58 for elevation displacement are here arranged at the outer periphery of the two geared rims. The variant according to FIG. 3 has been chosen as the drive for the two shafts.

The embodiment according to FIGS. 6 and 7, offers the advantage that the turntable may be supported by bearing means of comparatively small diameter, externally of the quarter-wave joint and more economically than in the embodiment according to FIG. 2 with its runners and support rollers.

The invention has here been described with reference to embodiments for ship-borne stations. However, given the necessary modifications, it is also applicable to ground stations, radar towers, or the like.

I claim:

1. In a rotatable aerial installation, especially for ship-borne and ground satellite stations of the type having a mast at the upper end of which rotatable basket means contains the transmitting/receiving aerial, the improvement comprising a turntable within the basket at the top of the mast mounted for rotation about a vertical axis, said turntable comprising a first rim with gearing for azimuth displacement of the aerial and a second rim with internal/external, double-gearing for elevational displacement of the aerial, differential gearing means comprising two drive shafts and two driven shafts, means for separately driving each of the drive shafts of the differential gearing, means for driving said first rim by means of one of the drive shafts of the differential gearing means, means for driving the second rim from the other of said drive shafts of the differential gearing means, a fixed wave guide extending upwardly to said turntable and concentric with the rotational axis of the latter, a quarter-wave joint mounted on the turntable and surrounding the upper end of said wave guide with a clearance therebetween, a wave guide probe extending from said turntable into said wave guide adapted to transmit signals between the wave guide and the aerial.

2. The rotatable aerial installation as claimed in claim 1 wherein said two drive shafts of the differential gearing means comprise a hollow shaft and a solid shaft, said solid shaft extending within the hollow shaft, said differential gearing means comprising two superposed epicyclic gear trains each having two planet gears and two satellite gears, and being connected together at adjacent planet gears which together form a double bevel gear, each gear train comprising a satellite carrier, one of said satellite carriers being fixed and the other being connected to drive means therefor.

3. The rotatable aerial installation as claimed in claim 2, wherein said first rim for azimuth displacement has internal gearing and is driven by a spur gear at the end of one of said hollow and solid shafts, said second rim being driven by a spur gear at the end of the other of the hollow and solid shafts meshing with the internal gearing thereof, gear means meshing with the exterior gearing of said second rim for controlling the elevation.

4. The rotatable aerial installations claimed in claim 2 wherein said first rim for azimuth displacement has external gearing and is driven by a spur gear at the end of one of said hollow and solid shafts, said second rim being driven by a spur gear at the end of the other of the hollow and solid shafts meshing with the external gearing thereof, gear means meshing with the interior gearing of said second rim for controlling the elevation.

5. The rotatable aerial installation as claimed in claim 1 wherein said two drive shafts of said differential gearing means are two parallel shafts, said differential gearing means comprising one epicyclic gear with two satellite gears and two planet gears, said satellite gears being connected to a surrounding movable carrier gear, said two planet gears being connected by gearing to said two drive shafts, motor means to drive the satellite carrier and motor means to drive one of said two parallel shafts directly.

* * * * *